US006142052A

United States Patent [19]

Endo

[11] Patent Number: 6,142,052

[45] Date of Patent: Nov. 7, 2000

[54] PUNCHING TOOL

[75] Inventor: Shigeru Endo, Kanagawa, Japan

[73] Assignee: Amada Metrecs Company, Limited, Kanagawa, Japan

[21] Appl. No.: 09/166,119

[22] Filed: Oct. 5, 1998

[30] Foreign Application Priority Data

Oct. 6, 1997 [JP] Japan ..... 9-272984

[51] Int. Cl.[7] ..... B26F 1/02

[52] U.S. Cl. ..... 83/522.18; 83/522.23; 83/699.41; 83/699.61

[58] Field of Search ..... 83/698.91, 699.41, 83/699.31, 699.61, 699.51, 685, 686, 690, 552, 522.16, 522.22, 522.23, 522.24, 522.18

[56] References Cited

U.S. PATENT DOCUMENTS

| | | | |
|---|---|---|---|
| 2,808,108 | 10/1957 | Pelligrino | 83/686 |
| 3,205,742 | 9/1965 | Williamson | 83/698.91 |
| 4,375,774 | 3/1983 | Wilson et al. . | |
| 5,020,407 | 6/1991 | Brinlee . | |
| 5,299,609 | 4/1994 | Wedler | 83/522.24 |
| 5,329,835 | 7/1994 | Timp et al. | 83/686 |

FOREIGN PATENT DOCUMENTS

| | | | |
|---|---|---|---|
| 0 622 135 A1 | 11/1994 | European Pat. Off. . | |
| 0 727 263 A1 | 8/1996 | European Pat. Off. . | |
| 2 233 269 | 1/1991 | United Kingdom | 83/552 |

*Primary Examiner*—Rinaldi Rada
*Assistant Examiner*—Kim Ngoc Tran
*Attorney, Agent, or Firm*—Blank Rome Comisky & McCauley LLP

[57] ABSTRACT

A punching tool includes: a punch driver transmitting an impact force to a punch body and having a screw portion on an outer peripheral surface of an upper portion; a punch head having a screw portion meshed with the screw portion of the punch driver on an inside surface and having a main scale provided in a vertical direction on an outside surface; a punch head rotation preventing means freely selecting a rotation and a fixation of the punch head with respect to the punch driver; and a punch head collar freely rotating and fixing with respect to the punch driver and provided with a sub scale showing a change of a height of the punch head in cooperation with the main scale.

5 Claims, 4 Drawing Sheets

PUNCHING TOOL

BACKGROUND OF THE INVENTION

1. Field of the Invention

The present invention relates to a punching tool, and more particularly to a punching tool used for a punching press or a turret punch press.

2. Description of the Related Art

In FIG. 1, a conventionally popular punching tool 101, for example, used for a turret punch press is shown. There are a hole punching tool, a forming tool and the like as the punching tool 101, however, in this case, the punching tool 101 as the forming tool is exemplified.

A punch driver 103 is provided above a punch P, and a male screw 105 is provided on an outer periphery of an upper end portion of the punch driver 103. A punch head 109 having a female screw 107 meshing with the male screw 105 formed inside is provided in the upper end portion of the punch driver 103, and a fastening ring 111 meshing with the male screw 105 of the punch driver 103 in the same manner is provided in the lower side of the punch head 109.

Accordingly, the punch head 109 and the fastening ring 111 can be fixed to the punch driver 103 by fastening them by means of a plurality of bolts 113 due to a mutual operation.

A punch guide 115 having a space therewithin is integrally mounted to the lower side of the punch driver 103, and a punch body 117 is provided in the inner space in a freely movable in a vertical direction. A urethane rubber 119 as an elastic body is inserted to the lower side of the punch body 117 in the inner space, and a punch tip 121 is provided in the lower side of the urethane rubber 119 in a freely movable in a vertical direction.

On the contrary, a die D is provided in a lower side in such a manner as to be opposite to the punch P. In the die D, a die tip 125 is fixed to a die body 123 by a bolt 127 and a mounting pin 129 so as not to rotate, and an ejector 131 is provided in a periphery of the die tip 125 so as to be urged upwardly by a spring 133.

In accordance with the structure mentioned above, the bolt 113 is loosened so that the punch head 109 and the fastening ring 111 are made in a rotatable state with respect to the punch driver 103, the punch head 109 is vertically moved by a rotation thereof, and the punch P is set to be a punch height corresponding to a thickness of a workpiece W and a processing condition. When the punch height is set to be a desired height, the bolt 113 is fastened so as to fix the punch head 109 and the fastening ring 111. Thereafter, the workpiece W is positioned between the punch P and the die D, and the punch head 109 is struck by a striker of the turret punch press so as to perform a desired punching process.

However, in the prior art of this kind, in the case of setting the punch P to be a desired punch height, since it is necessary to accurately measure a punch height by a Vernier calipers or the like after loosening the bolt 113, rotating the punch head 109 and adjusting the punch height, there are problems that the operation is very troublesome and requires a skill.

SUMMARY OF THE INVENTION

The present invention has been achieved with such points in view, and an object of the present invention is to provide a punching tool which can be easily set to be a desired punch height in correspondence to a processed thickness.

In order to achieve the object, a punching tool according to a first aspect of the present invention comprises: a punch driver transmitting an impact force to a punch body, the punch driver having a screw portion on an outer peripheral surface of an upper portion; a punch head having a screw portion meshed with the screw portion of the punch driver on an inside surface, the punch head having a main scale provided in a vertical direction on an outside surface; a punch head rotation preventing means freely selecting a rotation and a fixation of the punch head with respect to the punch driver; and a punch head collar freely rotating and fixing with respect to the punch driver, the punch head collar being provided with a sub scale showing a change of a height of the punch head in cooperation with the main scale.

Accordingly, the impact force is transmitted to the punch body through the punch driver by striking the punch head mounted to the punch driver through the screw portion. When the punch head is rotated so as to be relatively ascended with respect to the punch driver, the punch height becomes great. Inversely, when the punch head is rotated so as to be relatively descended with respect to the punch driver, the punch height becomes small. A changing amount of the punch height at this time is indicated by the main scale provided in the punch driver and the sub scale provided in the punch head collar.

According to a second aspect of the present invention, as it depends from the first aspect, the punch head rotation preventing means comprises: a plurality of grooves extending in a vertical direction on an outer peripheral surface of the punch driver; a stopper pin preventing the punch head from rotating by passing through the punch head so as to fit to the groove; and a collar freely movable in a vertical direction, and the collar being located outside the punch head, wherein the collar is urged upward at normal position during a normal time to insert the stopper pin to the groove; and the collar allows the punch head to rotate when the collar is moved downward.

Accordingly, at a normal time, since the collar presses the stopper pin passing through the punch head so as to fit to the groove in a vertical direction provided in the punch driver, the punch head is prevented from rotating. On the contrary, when the collar is descended, the stopper pin comes out from the groove of the punch driver so as to allow the punch head to rotate, so that the punch head is rotated with respect to the punch driver, and the punch height is adjusted.

According to a third aspect of the present invention, as it depends from the first aspect, wherein the main scale and the sub scale are set to show zero in case the thickness to be processed is zero; the main scale is provided so as to increase according to progressing upward from the lower portion; and the sub scale is provided in a direction of reducing the punch height.

Accordingly, the punch height is set by aligning the main scale and the sub scale with the processed thickness.

According to a fourth aspect of the present invention, as it depends from the first or the third aspect, wherein the screw portion of the punch driver and the screw portion of the punch head are provided such that the punch head vertically moves at a length of 1 mm with respect to the punch driver by rotating the punch head for one revolution with respect to the punch driver; the main scale is provided upward from the lower portion at 1 mm pitch; and the sub scale is provided in an upper end of the punch head collar freely rotating and fixing with respect to the punch driver at an equal interval.

Accordingly, the punch height is adjusted by rotating the punching head with respect to the punch driver, however, a change of the punch height at this time is read from the main scale and the sub scale.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
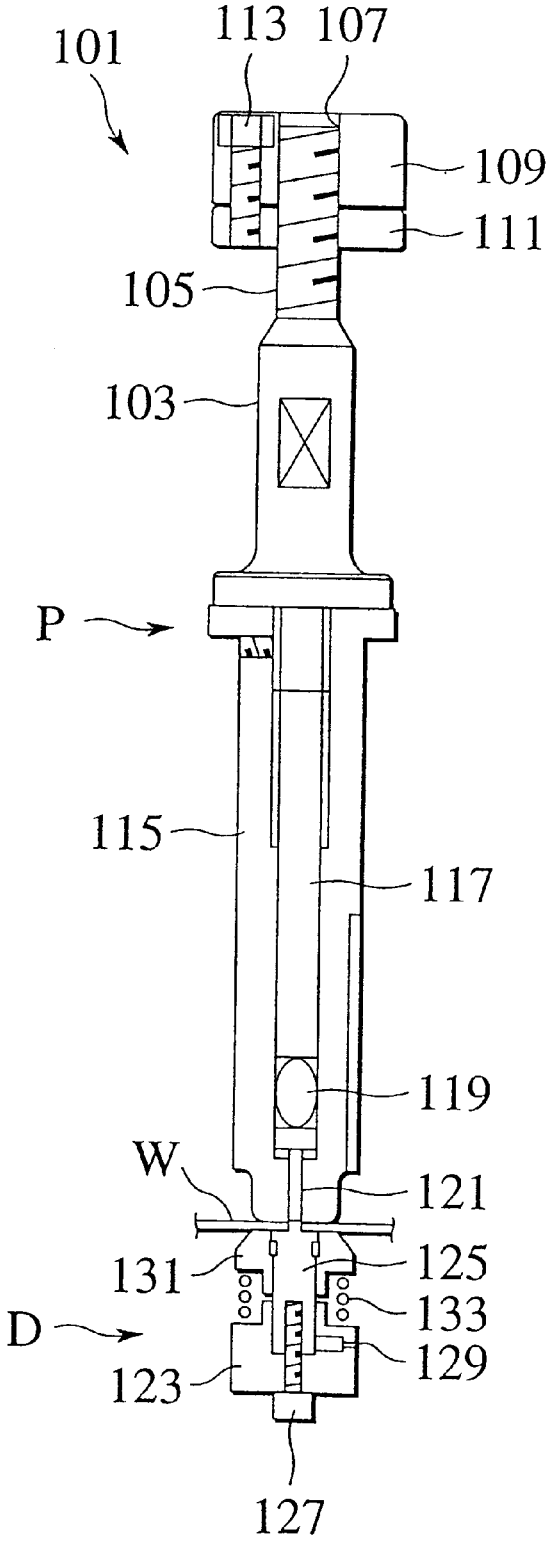
FIG. 1 (PRIOR ART)
FIG. 1 is a totally schematic view which shows a conventional punching tool.

There will be detailed below the preferred embodiments of the present invention with reference to the accompanying drawings. Like members are designated by like reference characters.

Figure 2:
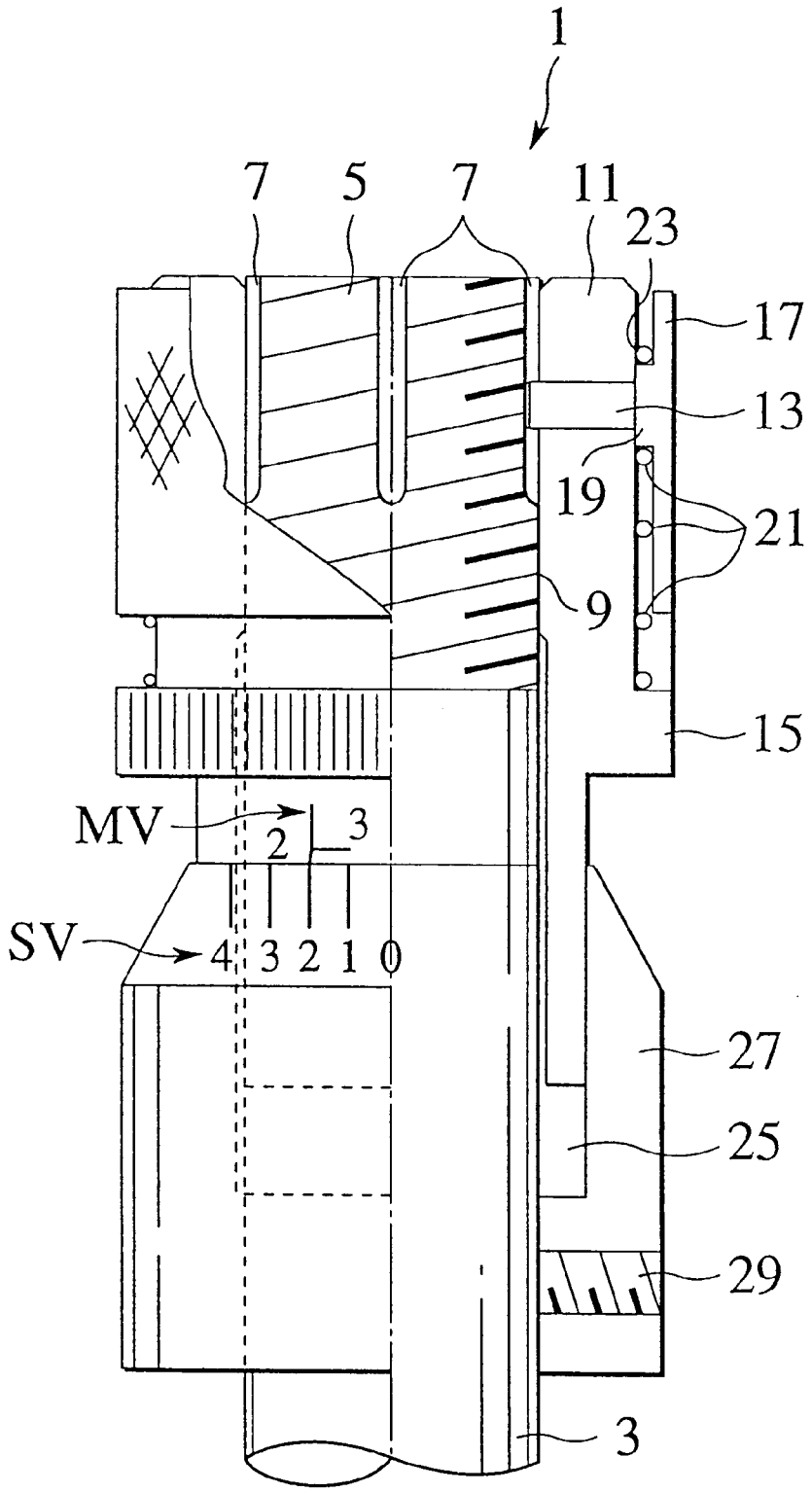
FIG. 2 is an enlarged schematic view which shows a main portion of a punching tool in accordance with the present invention.

In FIG. 2, a punching tool 1 in accordance with the present invention will be shown. In this case, the other portions than an upper portion of a punch P may be wholly the same as that shown in FIG. 1, or may be a forming tool, a hole punching tool or the like, so that an illustration and a description of the structure will be omitted.

With reference to FIG. 2, a male screw 5 as a screw portion is provided on an outer peripheral surface of an upper end portion of the punch driver 3, and a plurality of grooves 7 are further provided in a vertical direction on the outer peripheral surface. A punch head 11 having a female screw 9 meshed with the male screw 5 of the punch driver 3 formed on an inner surface is provided outside the punch driver 3.

Accordingly, the punch head 11 can be freely moved in a vertical direction with respect to the punch driver 3 by a rotation. Further, a stopper pin 13 as rotation preventing means always urged in a central direction (in a leftward direction in FIG. 2) by a spring (not shown) is provided near the upper end portion of the punch head 11.

A knob portion 15 having an outer diameter larger than the other portions is provided at a center portion of the punch head 11. A collar 17 is provided at an outer side above the knob portion 15 in the punch head 11 in a freely rotatable manner, a pressing projection 19 having a small inner diameter is provided on an inner surface of the collar 17, and a spring 21 is provided between the pressing projection 19 and the knob portion 15 of the punch head 11.

Accordingly, the collar 17 is always urged upwardly by the spring 21, so that the pressing projection 19 of the collar 17 is brought into contact with a snap ring 23 provided near the upper end portion of the punch head 11 so as to stop.

Further, in a state that the collar 17 is urged by the spring 21 so as to be brought into contact with the snap ring 23 so as to stop (a state shown in FIG. 2), the pressing projection 19 of the collar 17 is structured such as to press the stopper pin 13 of the punch head 11 in a central direction. Accordingly, since the stopper pin 13 is fitted to the groove 7 of the punch driver 3, the punch head 11 can not rotate with respect to the punch driver 3.

A main scale MV is notched in the lower side of the knob portion 15 on the outer peripheral surface of the punch head 11, for example, at a pitch of 1 mm from the lower portion to the upper portion in a vertical direction.

In the lower side of the punch head 11, a punch head collar 27 having a space to which the lower portion of the punch head 11 is rotatably inserted is provided so as to be freely rotate and fix with respect to the punch driver 3. The punch head collar 27 is structured such that it can prevent a rotation with respect to the punch driver 3 by a fastening or set screw 29. In this case, a sub scale SV is notched in an upper end portion of the punch head collar 27.

Next, a method of determining the main scale MV and the sub scale SV will be described below. Since the position of the main scale notched in the punch head 11 is not limited, the scale is provided at a prominent position in a vertical direction, for example, at a pitch of 1 mm from the lower portion to the upper portion.

On the contrary, the sub scale SV notched in the punch head collar 27 is determined by a relation between the female screw 9 on the inner surface of the punch head mentioned above and the male screw 5 provided on the outer peripheral surface of the punch driver 3. For example, in the case that the punch head 11 relatively moves in a vertical direction at 1 mm at a time of rotating the punch head 11 with respect to the punch driver 3 for a rotation, the sub scale SV notched in the punch head collar 27 is, for example, uniformly divided into ten portions in a periphery, whereby a vertical motion of the punch head 11 can be detected at an accuracy of 0.1 mm.

Accordingly, in the case that the punch head 11 vertically moves at 2 mm at a time of rotating the punch head 11 with respect to the punch driver 3 for a rotation, the sub scale SV of the punch head collar 27 is uniformly divided into twenty portions in a periphery, whereby an amount of the vertical motion of the punch head 11 can be apparently detected.

Next, with reference to FIGS. 3A, 3B, 3C, 4 and 5, an operation of setting that the punch P is provided with a desired punch height, a kind of die height, will be described hereinafter.

At first, a trial punching is performed to the workpiece W a thickness of which is known, so that the punch height is adjusted to be a regular height. At this time, the punch head collar 27 is made freely rotatable by loosening the fastening screw 29, the punch head collar 27 is rotated so that a value indicated by the main scale MV and the sub scale SV becomes the thickness of the trial punching, and the punch head collar 27 is fixed to the punch driver 3 by fastening the fastening screw 29.

Figure 3A:
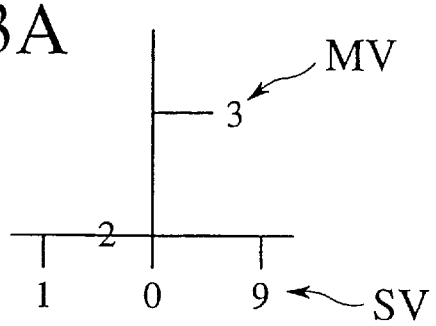
FIGS. 3A, 3B and 3C are schematic views which show an initially setting state of a main scale and a sub scale.
Figure 3B:
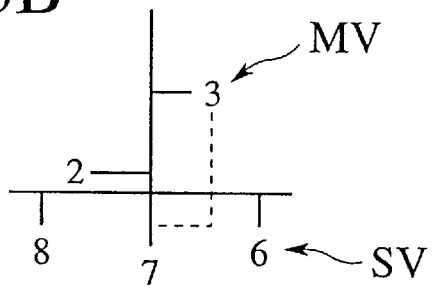
Figure 3C:
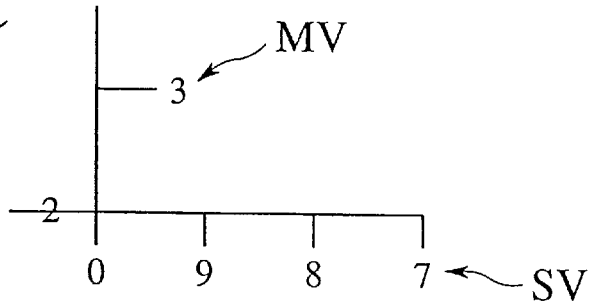

For example, when the trial punching is actually performed to the workpiece W having a thickness of 2 mm in a state shown in FIG. 3A, thereby performing an adjustment, the punch height shown by the scale (indicating 1.7 mm) as shown in FIG. 3B is obtained. However, since the true thickness is 2 mm, the punch head collar 27 is relatively rotated until the state shown in FIG. 3C and is fixed by the fastening screw 29.

Once set in the manner mentioned above, as shown in FIG. 5, an operator presses the collar 17 and holds the knob portion 15 of the punch head 11 so as to rotate the punch head collar 27 or the punch body 31. When the main scale MV and the sub scale SV are set to be a processed thickness, the punch height is a set thickness reduced. That is, the punch height can be adjusted by rotating the punch body 31 in a direction of an arrow L or an arrow S in the drawing.

Figure 4:
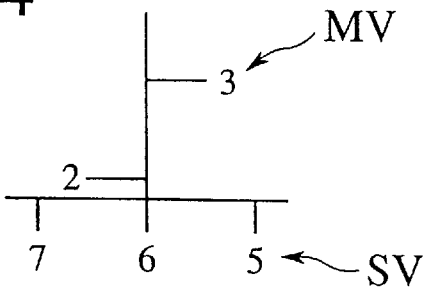
FIG. 4 is a schematic view which shows the main scale and the sub scale, for example, in the case that a thickness is 1.6 mm.
Figure 5:
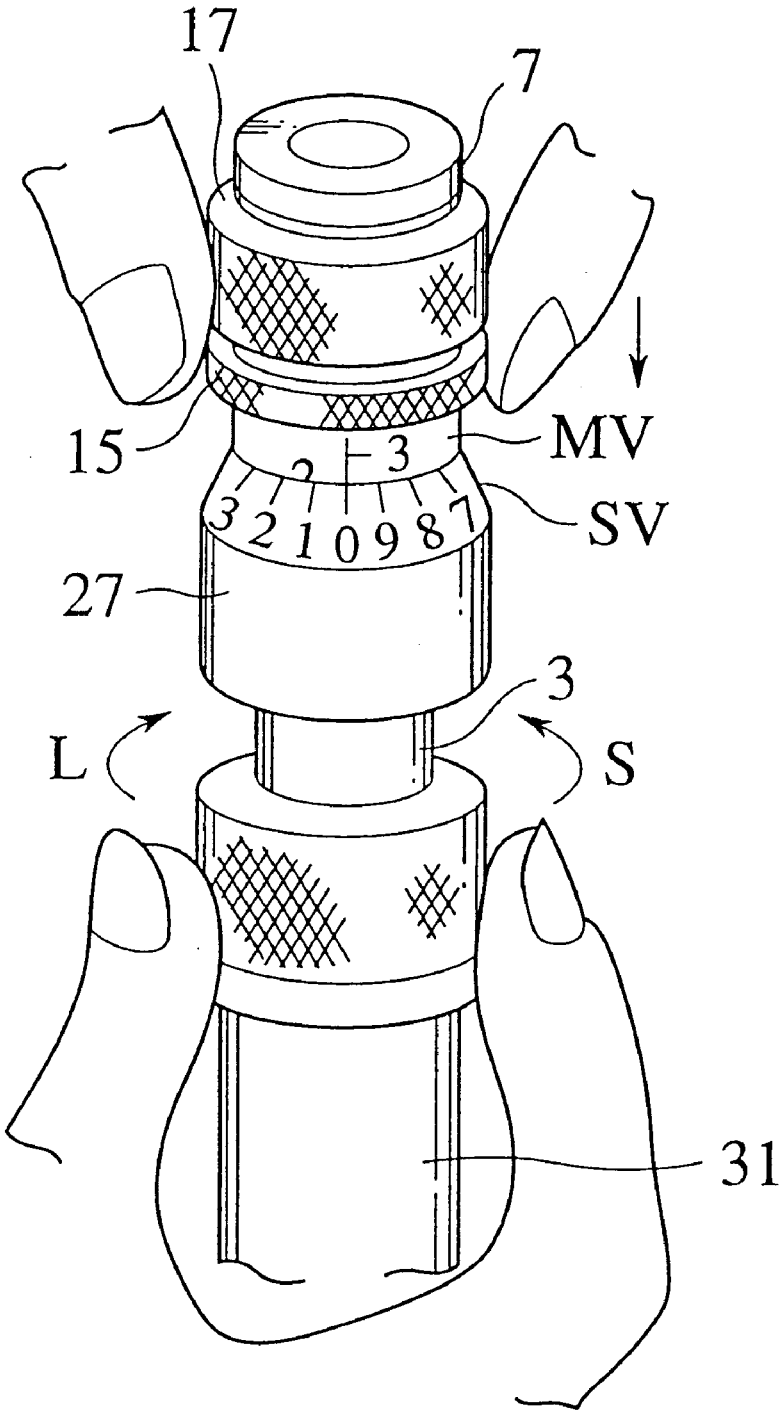
FIG. 5 is a perspective view which shows a state of adjusting a punch height in correspondence to the thickness.

For example, with reference to FIGS. 4, in the case that the thickness is 1.6 mm, the punch head collar 27 is rotated so as to be between 1 and 2 of the main scale MV, and is rotated so that 6 (indicating 0.6 mm) of the sub scale SV is positioned at a vertical line of the main scale MV. Accordingly, the punch height is set in correspondence to the thickness of 1.6 mm. After setting, the collar 17 is ascended to the upper end and the stopper pin 13 is fitted to the groove 7 of the punch driver 3, thereby preventing the punch head 11 from rotating.

As a result mentioned above, the punch height can be set to be a desired height in a one-touch manner by aligning the main scale MV and the sub scale SV with the processed thickness without using a tool even in the case of a person having no skill.

Further, since the punch head 11 is rotated with respect to the punch driver 3, and is set to be a desired punch height by using the main scale MV and the sub scale SV, the punch height can be accurately set without measuring by means of Vernier calipers or the like after setting in the conventional manner.

Still further, after setting, since the punch head 11 is prevented from rotating due to an effect of the collar 17 and the stopper pin 13, the punch height is prevented from changing.

Here, the present invention is not limited to the embodiment mentioned above, and can be realized in accordance with the other aspects by properly modifying. That is, in the embodiment mentioned above, the description is given to the case that the sub scale SV is uniformly divided into ten portions and a scale indicates a height of 0.1 mm, however, the sub scale SV may be uniformly divided into twenty portions and a scale may indicate 0.05 mm. Further, the sub scale SV may be finely provided and an accuracy of a scale of the sub scale SV may be finely set.

While preferred embodiments of the present invention have been described using specific terms, such description is for illustrative purpose, and it is to be understood that changes and variations may be made without departing from the spirit or scope of the following claims.

What is claimed is:

1. A punching tool, comprising:

a punch driver transmitting an impact force to a punch body, the punch driver including a screw portion on an outer peripheral surface of an upper portion;

a punch head including a screw portion meshed with the screw portion of the punch driver on an inside surface, the punch head including a main scale provided in a vertical direction on an outside surface;

a punch head rotation prevention mechanism to selectively fix the punch head with respect to the punch driver and release the punch head to rotate relative to the punch driver; and a punch head collar mounted to the punch driver, the punch head collar including a sub scale showing a change of a height of the punch head in cooperation with the main scale;

wherein the punch head rotation prevention mechanism comprises:

a plurality of grooves extending in a vertical direction on an outer peripheral surface of the punch driver;

a stopper pin preventing the punch head from rotating by passing through the punch head so as to fit to the groove; and a collar freely movable in a vertical direction, wherein the collar is located outside the punch head; wherein the collar is urged upward so as to insert the stopper pin into the groove so that the punch head cannot be rotated with respect to the punch drive; and wherein the collar allows the punch head to rotate when the collar is moved downward.

2. The punching tool according to claim 1, wherein the main scale and the sub scale are settable to show zero in case the thickness to be processed is zero; and the main scale increases a reading thereof during upward motion.

3. The punching tool according to claim 1, wherein each lead of the screw portion of the punch driver and the screw portion of the punch head is 1 mm;

a pitch of the main scale is 1 mm; and the sub scale is provided in an upper end of the punch head collar.

4. A punching tool, comprising:

a punch driver transmitting an impact force to a punch body, the punch driver including a screw portion on an outer peripheral surface of an upper portion;

a punch head including a screw portion meshed with the screw portion of the punch driver on an inside surface, the punch head including a main scale provided in a vertical direction on an outside surface;

a punch head rotation prevention mechanism to selectively fix the punch head with respect to the punch driver and release the punch head to rotate relative to the punch driver; and a punch head collar mounted to the punch driver, the punch head collar including a sub scale showing a change of a height of the punch head in cooperation with the main scale; and a fixing mechanism to releasably fix the sub scale against rotation about the punch driver.

5. The punching tool according to claim 4, wherein the fixing mechanism comprises a set screw.

* * * * *